US008490787B2

(12) United States Patent
Biedermann et al.

(10) Patent No.: US 8,490,787 B2
(45) Date of Patent: Jul. 23, 2013

(54) WATCH PRESENTATION CASE

(75) Inventors: Remo Biedermann, Sutz (CH); Joao Ornelas, Leira (PT)

(73) Assignee: Swatch S.A., Biel (CH)

( * ) Notice: Subject to any disclaimer, the term of this patent is extended or adjusted under 35 U.S.C. 154(b) by 168 days.

(21) Appl. No.: 13/122,635

(22) PCT Filed: Sep. 29, 2009

(86) PCT No.: PCT/EP2009/062644

§ 371 (c)(1), (2), (4) Date: Apr. 5, 2011

(87) PCT Pub. No.: WO2010/040667

PCT Pub. Date: Apr. 15, 2010

(65) Prior Publication Data

US 2011/0198248 A1 Aug. 18, 2011

(30) Foreign Application Priority Data

Oct. 6, 2008 (CH) ..... 1597/08

(51) Int. Cl.
*B65D 85/40* (2006.01)

(52) U.S. Cl.
USPC ..... 206/301; 206/18

(58) Field of Classification Search
USPC ..... 206/18, 301, 403, 416, 405, 406, 206/583; 220/4.22, 4.23
See application file for complete search history.

(56) References Cited

U.S. PATENT DOCUMENTS

| | | | | |
|---|---|---|---|---|
| 197,585 | A * | 11/1877 | Ashman | 206/314 |
| 2,120,826 | A | 6/1938 | Young | |
| 2,180,885 | A * | 11/1939 | Sundee | 206/6.1 |
| 4,767,000 | A | 8/1988 | Ovadia et al. | |
| 5,035,319 | A | 7/1991 | Kunisch | |
| 5,181,608 | A | 1/1993 | Herzog | |
| 5,322,159 | A | 6/1994 | Houlihan | |
| 6,378,696 | B1 * | 4/2002 | Smouha | 206/18 |
| 6,478,160 | B1 | 11/2002 | Au et al. | |
| 2002/0195364 | A1 * | 12/2002 | Grcic et al. | 206/403 |
| 2004/0035725 | A1 * | 2/2004 | Smouha | 206/301 |
| 2006/0042995 | A1 * | 3/2006 | McGrath et al. | 206/583 |
| 2007/0151878 | A1 * | 7/2007 | Au | 206/301 |

OTHER PUBLICATIONS

International Search Report issued in corresponding application No. PCT/EP2009/062644, completed Dec. 10, 2009 and mailed Dec. 16, 2009.

Random House Webster's College Dictionary 85, 1260 and 1261 (1991).

* cited by examiner

*Primary Examiner* — David Fidei
(74) *Attorney, Agent, or Firm* — Griffin & Szipl, P.C.

(57) ABSTRACT

The invention relates to a case for receiving, in a fixed position, an article secured to a support (5). This case (1) includes a bottom part (3) forming the base and a top part (2) forming the cover. The bottom part (3) and top part (2) cooperate with each other to define a closed space in a closed position. The support (4) includes holding means (6) so that the article does not rest on the base, or against the cover.

15 Claims, 2 Drawing Sheets

WATCH PRESENTATION CASE

This is a National Phase Application in the United States of International Patent Application PCT/EP2009/062644 filed Sep. 29, 2009, which claims priority on Swiss Patent Application No. 01597/08 of Oct. 6, 2008. The entire disclosures of the above patent applications are hereby incorporated by reference.

FIELD OF THE INVENTION

The invention concerns a case or a container for receiving, in a fixed position, an article secured to a support. This case includes a bottom part forming the base and a top part forming the cover. The bottom and top parts cooperate with each other to define a closed space when the case is in a closed position.

BACKGROUND OF THE INVENTION

Presentation cases or containers for watches are known from the prior art. These cases take the form of a parallelepiped box, comprising a base and a cover, and generally containing a support. The support is generally placed in the bottom of the case and is used for holding the article, in a fixed position when the article is placed in the case.

For watch models within the upper market range, the inside of the case is leather or alcantara. The support then takes the form of a cushion covered in the same material as that covering the case therefore watch, onto which the watch is attached. For watch belonging to the lower market range models, the support takes the form of a foam or plastic part. In the latter case, the support is then in the shape of an arch that rests or is fixed on the bottom of the case.

However, the position of the article, such as a watch, on the support raises some problems. In fact, the watch is placed on the support as if it were attached to a wrist. Thus, when the support is placed in the case, the support-watch assembly generally rests on the watch wristband or bracelet. The fact that the support-watch assembly is pressing on the bracelet may then damage the bracelet.

Moreover, the support is generally sized so that it is not free to move once placed in the case. This is generally achieved by making the width of the support the same size as the inner width of the case. This blocks the support in the case making it incapable of any movement and resistant to any shocks that the case might undergo. This arrangement consequently provides better protection for the article secured to the support.

However, although this arrangement protects the article from any shocks experienced by the case, the positioning of the support on the bottom of the case makes it more difficult to take hold of the watch. It is thus usual for the support to be inserted or removed from the case by gripping the article secured to the support, with the risk that this will damage or spoil the article.

SUMMARY OF THE INVENTION

It is an object of the present invention to overcome the aforementioned drawbacks of the prior art by proposing a case wherein the article that has to be placed therein can be inserted in and removed from the case in a simple manner while, still being protected from shocks.

The invention therefore concerns the aforecited case, characterized in that the support includes holding means, which are arranged so that the article is not resting on the bottom, or against the cover.

One advantage of this case is therefore that it makes it easier to place the article in the case. Indeed, the support to which the article is secured is not in the bottom of the case. This allows the user of the case to secure the article to the support and put the support in the case or remove it therefrom very easily.

This also means that the case and the support can be secured to each other, thus preventing the support from moving under the effect of shocks. The article secured to the support is then protected from external shocks.

Thus, in accordance with a first non-limiting, illustrative embodiment of the present invention, a case is provided for receiving, in a fixed position, an article secured to a support (5), wherein the case (1) includes a bottom part (3) forming the base and a top part (2) forming the cover, wherein the bottom (3) and top (2) parts cooperate with each other to define a closed space in a closed position, and the case (1) is characterized in that the support (5) includes holding means (6) so that the article does not rest on the base, nor against the cover.

Advantageous embodiments of this case form the subject of the following additional non-limiting illustrative embodiments. In accordance with a second non-limiting illustrative embodiment of the present invention, the first non-limiting embodiment is modified so that in the closed position of the case (1), there are at least two gaps (4) between the base (3) and the cover (2) of the case, and the support (5) rests in the gaps (4) via the holding means (6). In accordance with a third non-limiting illustrative embodiment of the present invention, the second non-limiting embodiment is further modified so that the holding means (6) are formed by at least two shoulders (6). In accordance with a fourth non-limiting illustrative embodiment of the present invention, the first, second and third non-limiting embodiments are further modified so that it is made of a transparent or semi-transparent material. In accordance with a fifth non-limiting illustrative embodiment of the present invention, the first, second, third and fourth non-limiting embodiments are further modified so that the support (5) includes ribs (7) limiting the transverse movements of the support. In accordance with a sixth non-limiting illustrative embodiment of the present invention, the fifth non-limiting embodiment is further modified so that the ribs (7) of the support (5) are extended by side edges (10). In accordance with a seventh non-limiting illustrative embodiment of the present invention, the sixth non-limiting embodiment is further modified so that the edges (10) of the support (5) include at least one pattern in relief. In accordance with an eighth non-limiting illustrative embodiment of the present invention, the seventh non-limiting embodiment is further modified so that it includes at least one pattern in relief arranged for cooperating with the pattern of the support (5) to achieve an effect of depth.

In accordance with a ninth non-limiting illustrative embodiment of the present invention, the first, second, third, fourth, fifth, sixth, seventh, and eighth non-limiting embodiments are further modified so that the support (5) is C-shaped. In accordance with a tenth non-limiting illustrative embodiment of the present invention, the ninth non-limiting embodiment is further modified so that the ends of the C-shaped support (5) are at least partially flexible. In accordance with an eleventh non-limiting illustrative embodiment of the present invention, the first, second, third, fourth, fifth, sixth, seventh, eighth, ninth, and tenth non-limiting embodiments are further modified so that the bottom (3) and top (2) parts are hinged to each other. In accordance with a twelfth non-limiting illustrative embodiment of the present invention, the first, second, third, fourth, fifth, sixth, seventh, eighth, ninth, tenth and eleventh non-limiting embodiments are further modified so that the bottom (3) and top (2) parts include locking means (9) for locking the case (1) in a closed position.

According to a particularly advantageous aspect of the invention, the case is made of a transparent material allowing the article to be seen from outside the case. The transparency of the case also means that the support can be associated with the case to achieve advantageous visual effects.

BRIEF DESCRIPTION OF THE DRAWINGS

The objects, advantages and features of the case according to the present invention will appear more clearly upon reading the following detailed description of at least one embodiment of the invention, given purely by way of non-limiting example and illustrated by the annexed drawings, in which.

DETAILED DESCRIPTION

A presentation case for a watch will be used as an example in the following description. However, this example will be used by way of non-limiting example, as the presentation case could be used for bracelets, earrings, rings or other articles.

Figure 1:
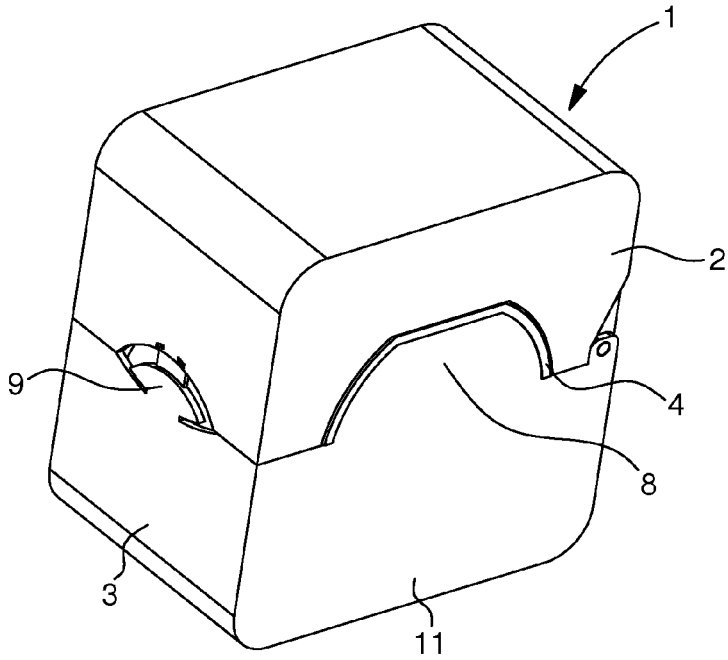
FIG. 1 shows schematically the case according to the present invention in its closed position.
Figure 2:
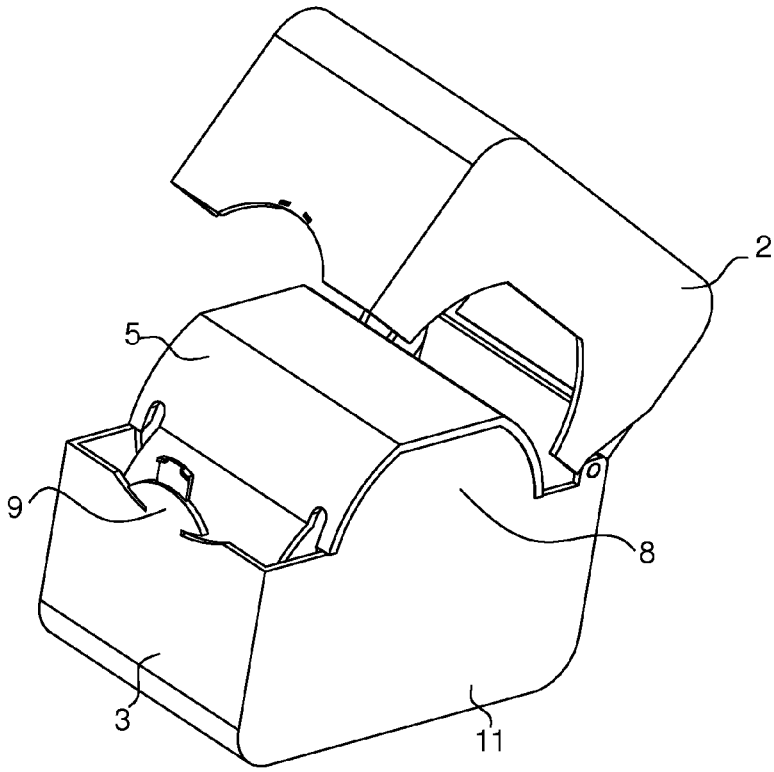
FIG. 2 shows a view of the case according to the present invention in which it is partially open.

FIGS. 1 and 2 show the presentation case according to the present invention. This presentation case takes the form of a case or box 1. Case 1 is formed of two parts: a bottom part 3 forming the base and a top part 2 forming the cover. These two parts 2, 3 cooperate with each other to form a closed space when the case is in the closed position. As shown in FIG. 1, the two parts 2, 3 are connected to each other by means of a hinge so that case 1 can be opened by tipping back top part 2 with respect to bottom part 3. Of course, it would be possible for the two top and bottom parts 2, 3 to be unconnected to each other, with one simply fitted on top of the other. It will be clear that, a front view of case 1 means looking at it along the longitudinal axis, whereas a profile view of case 1 means looking at the case along the transverse axis.

Moreover, the case shown in FIG. 1 includes locking means 9 for locking the case in the closed position. These locking means 9 may be snap fit means or any other known means. Of course, it is clear that it is possible to omit these locking means.

A support 5 is housed inside case 1, as seen in FIG. 2. This support 5 is used for securing the watch that one wishes to place in the presentation case. In order to make it easier to place the support-watch assembly in case 1, the present invention proposes that the support-watch assembly is carried by the edges of case 1, so that the article is not resting on the bottom, nor against the cover of case 1.

First of all, case 1 is made such that a gap 4 appears between bottom part 3 and top part 2 on either side of case 1 when top part 2 is closed onto bottom part 3. This gap 4 is rectilinear in the example shown, but other shapes could be envisaged. The gaps are preferably located on two opposite sides of case 1. Case 1 could also include more than one gap 4 per side, with the gaps then taking the shape of slits. Of course, it would be possible for gaps to be in different planes, with top part 2 and bottom part 3 then being made accordingly.

Figure 3:
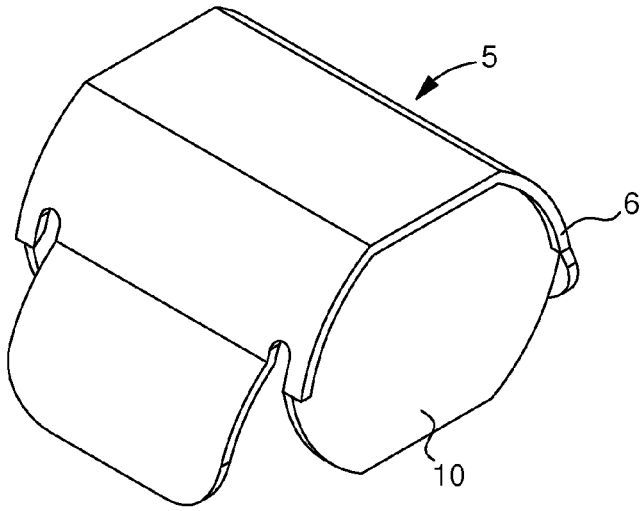
FIG. 3 shows schematically a perspective view of the support.
Figure 4:
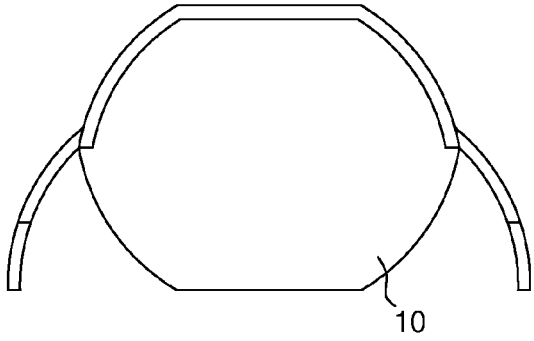
FIGS. 4 and 5 show respectively a profile and front view of the support.
Figure 5:
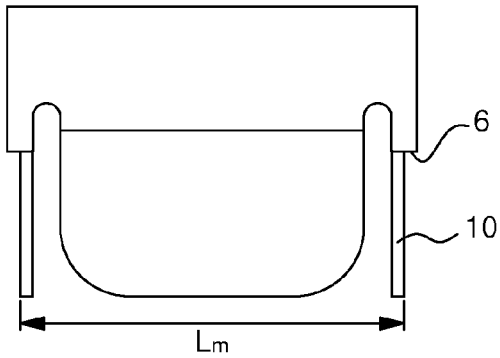

Secondly, support 5, shown in FIGS. 3 to 5, is altered so that it can rest on edges 11 of case 1. More specifically, support 5 is altered so as to rest on gaps 4. In order to do this, the support has holding means 6. These holding means take the form of shoulders. Shoulders 6 project over the sides of support 5. This arrangement allows shoulders 6 to rest on edges 11 of the case at gaps 4. Once case 1 is in its closed position, the shoulders 6 then limit the movements of support 5. The dimensions of shoulders are at least equal to those of gap 4. Preferably, shoulders 6 have the same dimensions as gaps 4 so that support 5 is held as well as possible in gaps 4. In the variant in which case 1 has gaps in the form of slots 4, support 5 is then fitted with a number of shoulders 6 equal to the number of slots 4.

In a preferred embodiment illustrated in FIGS. 1 to 5, case 1 includes two gaps 4 and they are not rectilinear. Indeed, as seen in FIGS. 1 to 5, top part 3 is arranged to offer additional means for holding support 5. These additional holding means are at the joint between bottom part 3 and top part 2. The holding means for support 5 thus consist of a projecting portion 8 made on two opposite sides of case 1 and which takes the form of a profile formed of two portions in the arc of a circle connected to each other by a rectilinear portion. These projecting parts 8 cooperate with support 5 at shoulders 6. In order to do this, shoulders 6 are made in a complementary shape to projecting parts 8 so that shoulders 6 can abut perfectly on the projecting parts 8. This provides a longitudinal support for support 5. Top part 2 is of course indented so that bottom part 3 and top part 2 can cooperate with each other to close the case 1 when support 5 is placed therein. In order to do this, top part 2 is made so that each opposite side has an indentation of complementary shape to projecting parts 8 of bottom part 3. The dimensions of these indentations are then adapted to form the gaps 4.

In a variant of this embodiment, support 5 is provided with transverse holding means 7 for holding support 5 both longitudinally and laterally. In order to do this, a rib 7 is placed on each side of support 5 at shoulders 6 so that the distance Lm between these ribs 7 is at most equal to the distance between the walls of case 1. Thereafter, support 5 cannot move transversally.

In another variant of this embodiment, ribs 7 extend to act as a side edge 10 for the support 5 as seen in FIGS. 3, 4 and 5. These side edges 10 then also act as guide means. Indeed, side edges 10 are separated by a distance equal at most to the inner width of the case. Thus, when the ribs are extended to act as edges, this facilitates the guiding of support 5, since edges 10 will be inserted into case 1 first, thus ensuring that support 5 is positioned properly.

Bottom part 3 and top part 2 could also be made of transparent material. This transparency would enable the user to see the product inside case 1 without opening the case. This transparent appearance could be used for aesthetic purposes. Indeed, one of the uses of this transparent appearance is a three-dimensional display. For example, edges 10 of support 5 are used and associated with this transparent appearance to achieve this effect. In order to do this, edges 11 of the case and edges 10 of the support are etched in the same pattern so that, when the support is positioned in case 1, the patterns are superposed. Superposing the transparent etch on case 1 with the etch on support 5 gives an effect of depth that improves the aesthetic appearance of case 1.

One variant of the invention concerns making support 5 more practical to use. Support 5 is thus given a C shape with a slight flattening at the centre of the curve. This shape is very practical when used with a watch, since the watchcase can be placed on the flattened portion, while the ends allow the bracelet to adopt a curved profile almost identical to that of a wrist.

According to another possible variant of the support, the ends of support 5 are flexible. This flexibility means that the watch bracelet is subjected to less stress when the watch is secured to the support.

Thus, in view of the above description, the invention relates broadly to a case for receiving, in a fixed position, an article secured to a support (5). This case (1) includes a bottom part (3) forming the base and a top part (2) forming the cover. The bottom part (3) and top part (2) cooperate with each other to define a closed space in a closed position. The support (4) includes holding means (6) so that the article does not rest on the base, or against the cover. Of course, the case (1) may be a watch presentation case and the article secured in the case may be a watch. It will be clear, however, that various alterations and/or improvements and/or combinations that are evident to those skilled in the art may be made to the various embodiments of the invention explained above, without departing from the scope of the invention defined by the annexed claims.

Indeed, it is clear that support 5 could take the shape of a tray on which jewelry is placed. Support 5 could also be trapezoidal so that the watchcase rests on the tip of the trapeze.

The invention claimed is:

1. A case for receiving, in a fixed position, an article secured to a support held by the case, wherein the case includes:

(a) a bottom part forming a base; and (b) a top part forming a cover, wherein the bottom part and the top part cooperate with each other to define a closed space in a closed position, and the support includes first holding means so that the article does not rest on the base, nor against the cover of the case, wherein in the closed position of the case, there are at least two gaps disposed between the base and the cover of the case at a joint between the bottom part and the top part, and the support rests in the at least two gaps via the first holding means.

2. The case according to claim 1, wherein the first holding means are formed by at least two shoulders of the support.

3. The case according to claim 1, wherein the case is made of a transparent or semi-transparent material.

4. The case according to claim 1, wherein the support further includes transverse holding means comprising ribs limiting the transverse movements of the support.

5. The case according to claim 4, wherein the ribs of the support are extended by side edges.

6. The case according to claim 5, wherein the edges of the support include at least one pattern in relief.

7. The case according to claim 6, wherein the case further includes at least one pattern in relief arranged for cooperating with the pattern of the support to achieve an effect of depth.

8. The case according to claim 1, wherein the support is C-shaped.

9. The case according to claim 8, wherein ends of the C-shaped support are at least partially flexible.

10. The case according to claim 1, wherein the bottom part and top part are hinged to each other.

11. The case according to claim 1, wherein the bottom part and top part include locking means for locking the case in the closed position.

12. The case according to claim 2, wherein the case is made of a transparent or semi-transparent material.

13. The case according to claim 1, wherein each of the at least two gaps is a slit or slot defined by the bottom part and the top part of the case.

14. The case according to claim 13, wherein each of the at least two gaps is not rectilinear.

15. The case according to claim 13, wherein each of the at least two gaps is rectilinear.

* * * * *